US010248065B1

(12) United States Patent
Saito et al.

(10) Patent No.: US 10,248,065 B1
(45) Date of Patent: Apr. 2, 2019

(54) IMAGE FORMATION CONTROL APPARATUS AND IMAGE FORMING APPARATUS

(71) Applicant: FUJI XEROX CO.,LTD., Tokyo (JP)

(72) Inventors: Takayuki Saito, Kanagawa (JP); Nobuyuki Kuto, Kanagawa (JP); Marie Amaki, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 15/975,776

(22) Filed: May 10, 2018

(30) Foreign Application Priority Data

Oct. 3, 2017 (JP) ..... 2017-193359

(51) Int. Cl.
*G03G 15/00* (2006.01)

(52) U.S. Cl.
CPC ..... *G03G 15/5062* (2013.01); *G03G 15/6529* (2013.01); *G03G 2215/00556* (2013.01)

(58) Field of Classification Search
CPC ..... G03G 15/5062; G03G 15/6529; G03G 15/50; G03G 15/5016; G03G 15/5029
USPC ..... 399/38, 45, 66, 75, 81
See application file for complete search history.

(56) References Cited

U.S. PATENT DOCUMENTS 7,424,239 B2 * 9/2008 Mita ..... G03G 15/50 399/87
9,829,832 B2 11/2017 Yonesaka et al.
2017/0082955 A1 3/2017 Yonesaka et al.

FOREIGN PATENT DOCUMENTS

JP 2009134092 6/2009
JP 2017058655 3/2017

* cited by examiner

*Primary Examiner* — William J Royer
(74) *Attorney, Agent, or Firm* — JCIPRNET

(57) ABSTRACT

An image formation control apparatus includes a setting reception section that collectively receives settings of a plurality of adjustment factors with respect to image formation, an instruction section that instructs an image forming apparatus main body to perform adjustments with respect to the settings of the adjustment factors, which are received by the setting reception section, an adjustment result reception section that receives results of the adjustments of the respective adjustment factors, which are instructed by the instruction section, in the image forming apparatus main body, and a controller that performs control such that the results of the adjustments of the respective adjustment factors, which are received by the adjustment result reception section, are stored in company with a recording medium accommodation unit that accommodates a recording medium.

20 Claims, 11 Drawing Sheets

FIG. 12

| | TRAY | RECORDING MEDIUM | DEVIATION QUANTITY | SECONDARY TRANSFERENCE VOLTAGE | |
|---|---|---|---|---|---|
| STOCK 1 | | | | | ..... |
| STOCK 2 | | | | | ..... |
| ..... | ..... | ..... | ..... | ..... | ..... |

IMAGE FORMATION CONTROL APPARATUS AND IMAGE FORMING APPARATUS

CROSS-REFERENCE TO RELATED APPLICATIONS

This application is based on and claims priority under 35 USC 119 from Japanese Patent Application No. 2017-193359 filed Oct. 3, 2017.

BACKGROUND

Technical Field

The present invention relates to an image formation control apparatus and an image forming apparatus.

SUMMARY

According to an aspect of the invention, there is provided an image formation control apparatus including: a setting reception section that collectively receives settings of plural adjustment factors with respect to image formation; an instruction section that instructs an image forming apparatus main body to perform adjustments with respect to the settings of the adjustment factors, which are received by the setting reception section; an adjustment result reception section that receives results of the adjustments of the respective adjustment factors, which are instructed by the instruction section, in the image forming apparatus main body; and a controller that performs control such that the results of the adjustments of the respective adjustment factors, which are received by the adjustment result reception section, are stored in company with a recording medium accommodation unit that accommodates a recording medium.

Meanwhile, here, "collectively receive" refers to "receive after gathering into one bundle as the setting", and is not limited to "receive by one operation". The operation may be performed in plural times.

Here, the adjustment factor is a target item to be adjusted for image formation.

BRIEF DESCRIPTION OF THE DRAWINGS

Exemplary embodiment(s) of the present invention will be described in detail based on the following figures, wherein:

FIG. 12 is a table illustrating content of the database in the image formation control apparatus according to the exemplary embodiment of the present invention.

DETAILED DESCRIPTION

Subsequently, an exemplary embodiment of the present invention will be described in detail with reference to the accompanying drawings.

Figure 1:
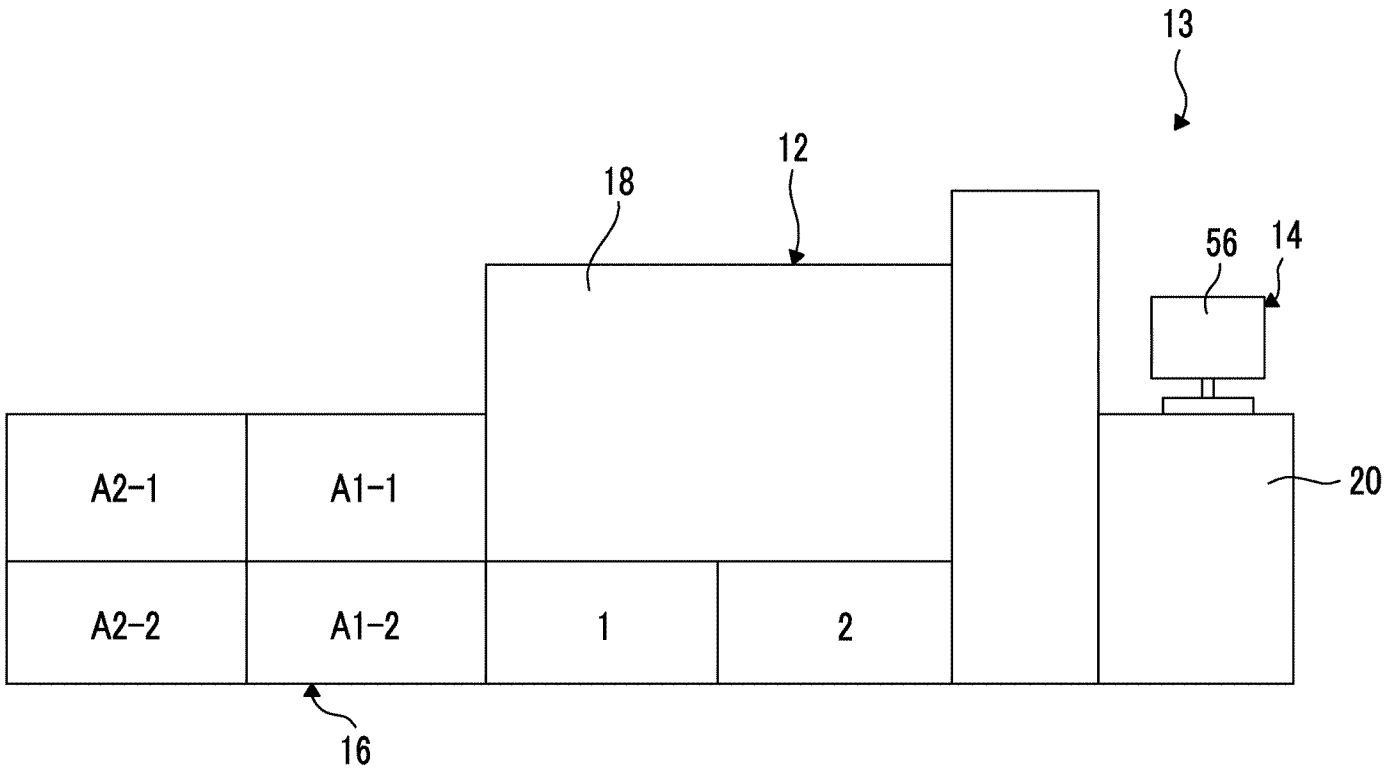
FIG. 1 is a front view illustrating an image forming apparatus according to an exemplary embodiment of the present invention.

FIG. 1 illustrates an image forming apparatus 13 according to the exemplary embodiment of the present invention.

The image forming apparatus 13 is configured with an image forming apparatus main body 12 and an image formation control apparatus 14. The image forming apparatus main body 12 includes a recording medium accommodation unit 16, an image forming section 18, and an output unit 20.

The recording medium accommodation unit 16 includes, for example, six parts, and names are attached to the respective parts. That is, as illustrated in FIG. 1, the recording medium accommodation unit 16 is configured with respective trays 1, 2, A1-1, A1-2, A2-1, and A2-2, and, hereinafter, in a case where the respective trays are distinguished from each other, the respective trays are described as a tray 1, a tray 2, and a tray A1-1. Plural pieces of paper or OHP, which is a recording medium, are laminated on the respective parts of the recording medium accommodation unit 16, and are fed into the image forming section 18, which will be described later, one by one from an uppermost recording medium.

Figure 2:
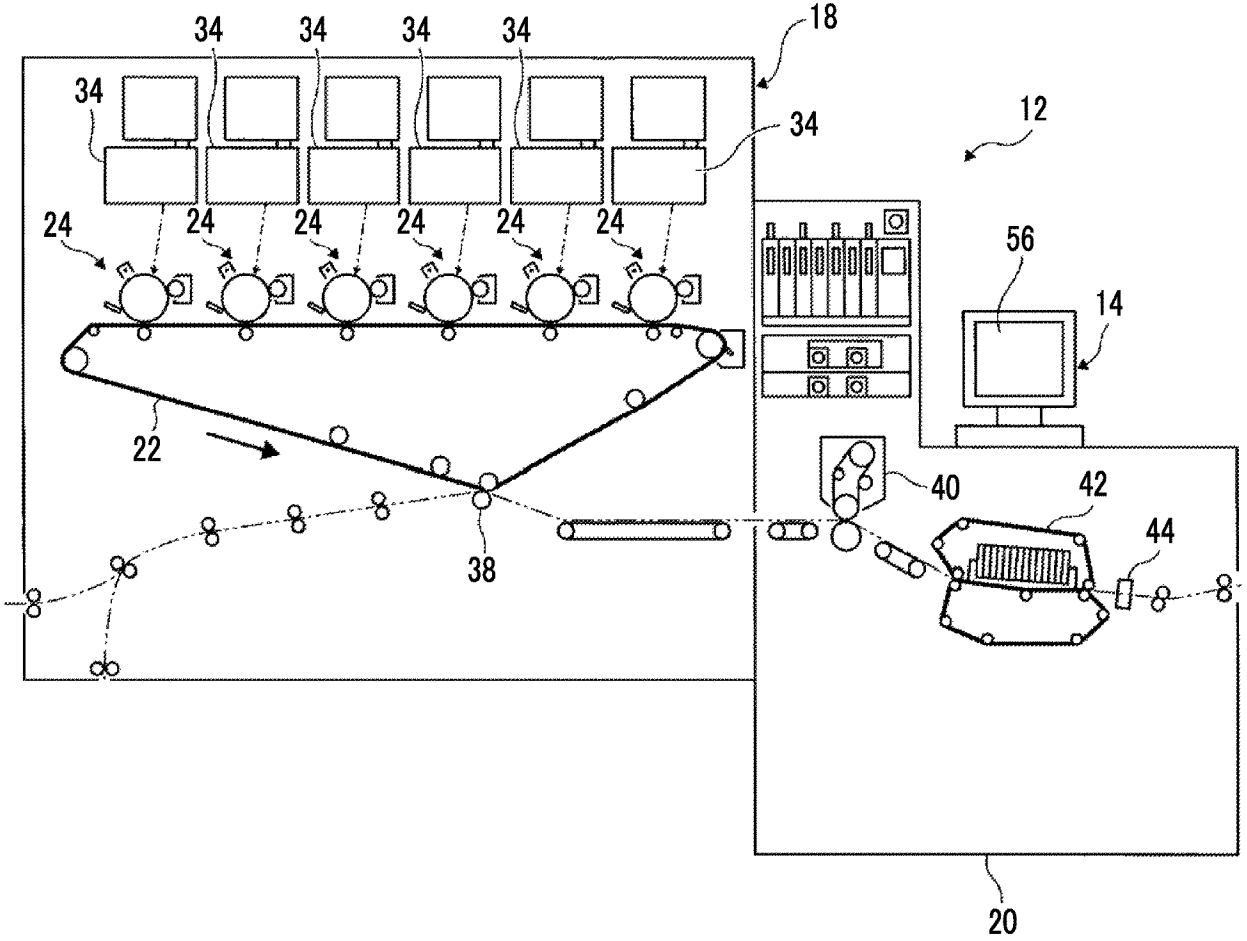
FIG. 2 is a schematic diagram illustrating an image forming apparatus main body used in the exemplary embodiment of the present invention.

The image forming section 18 has, for example, a structure as illustrated in FIG. 2.

That is, the image forming section 18 includes an intermediate transfer belt 22. For example, six image forming units 24 are provided at an upper part of the intermediate transfer belt 22. The image forming units 24 form an image using toner, which is selected among a color of gold, a color of silver, a transparent color, a color of white, a color of orange, and a color of Chinese red, as specific color developer in addition to basic color developers including a color of yellow, a color of magenta, a color of cyan, and a color of black. In the exemplary embodiment, the image forming units 24, which have the color of silver, the color of yellow, the color of magenta, the color of cyan, the color of black, and the transparent color, are disposed from a downstream side.

Figure 3:
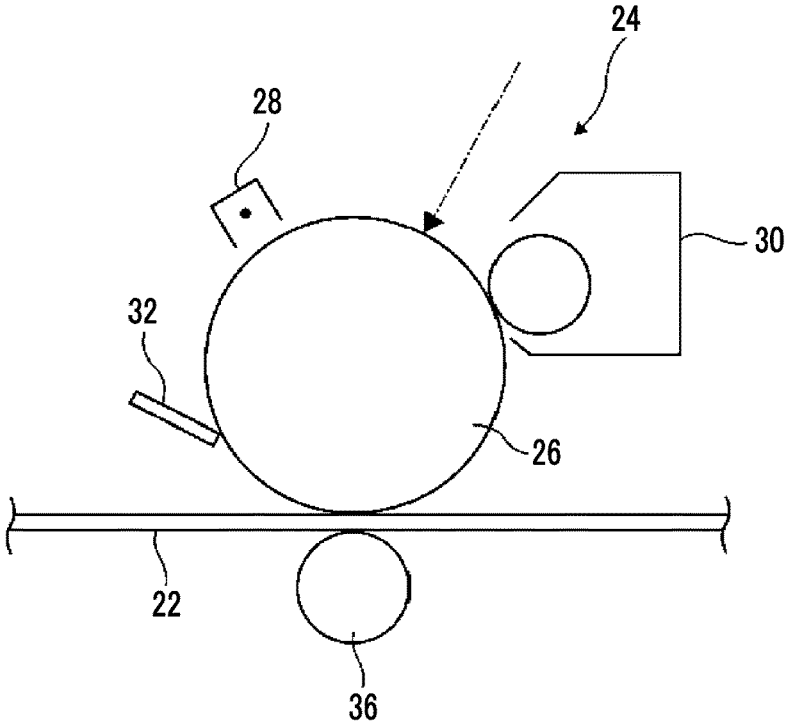
FIG. 3 is a side diagram illustrating an image forming section in the image forming apparatus used in the exemplary embodiment of the present invention.

As illustrated in FIG. 3, the image forming unit 24 uses, for example, a xerography method, and is configured with a photosensitive drum 26, an electrification device 28 which functions as an electrification section that uniformly electrifies a surface of the photosensitive drum 26, a development device 30 which develops an electrostatic latent image that is formed on the photosensitive drum 26, and a cleaning device 32. The photosensitive drum 26 is a cylindrical image holder, which holds a toner image and which is uniformly electrified by the electrification device 28, and the electrostatic latent image is formed by laser beams which are irradiated by an optical scanning device 34. The electrostatic latent image which is formed on the photosensitive drum 26 is developed by the development device 30 using the toner. A primary transfer roller 36 is provided at a location which faces the photosensitive drum 26 while interposing the intermediate transfer belt 22 between the primary transfer roller 36 and the photosensitive drum 26. The toner image which is developed by the development device 30 is transferred to the intermediate transfer belt 22 by applying a primary transfer voltage to the primary transfer roller 36. Meanwhile, residual toner, paper powder, and the like, which are attached to the photosensitive drum 26 after a procedure for transferring the toner image, are removed by the cleaning device 32.

In addition, as illustrated in FIG. 2, a secondary transfer roller 38, which faces the intermediate transfer belt 22, is provided at a lower end of the intermediate transfer belt 22. The recording medium is conveyed between the intermediate transfer belt 22 and the secondary transfer roller 38. The toner image, which is transferred to the intermediate transfer belt 22 by the image forming unit 24, is secondarily transferred to the recording medium, which is supplied from the recording medium accommodation unit 16, by applying a secondary transfer voltage to the secondary transfer roller 38. A toner quantity for the secondary transfer, that is, a density of the image is adjusted according to a change in the secondary transfer voltage.

As illustrated in FIG. 2, the output unit 20 includes a fixing unit 40 and a cooling unit 42. The recording medium, to which the image is transferred, is transmitted to the fixing unit 40 and the image is fixed by, for example, heat and pressure. The recording medium, to which the image is fixed as described above, is further cooled by the cooling unit 42.

Meanwhile, although the image forming section 18 is provided such that the image is formed on only a first surface of the paper, the image may be formed on a second surface by providing an inverting unit on a paper conveyance path.

In addition, a reading device 44 is provided in the output unit 20. The reading device 44 reads, for example, the recording medium and the image, which is transferred to the recording medium, using a CCD or the like.

The recording medium, which is output from the output unit 20, is discharged to a discharge unit, which is not illustrated in the drawing, and is further conveyed to a post-processing apparatus, such as a stapler, such that a post-processing is performed.

Figure 4:
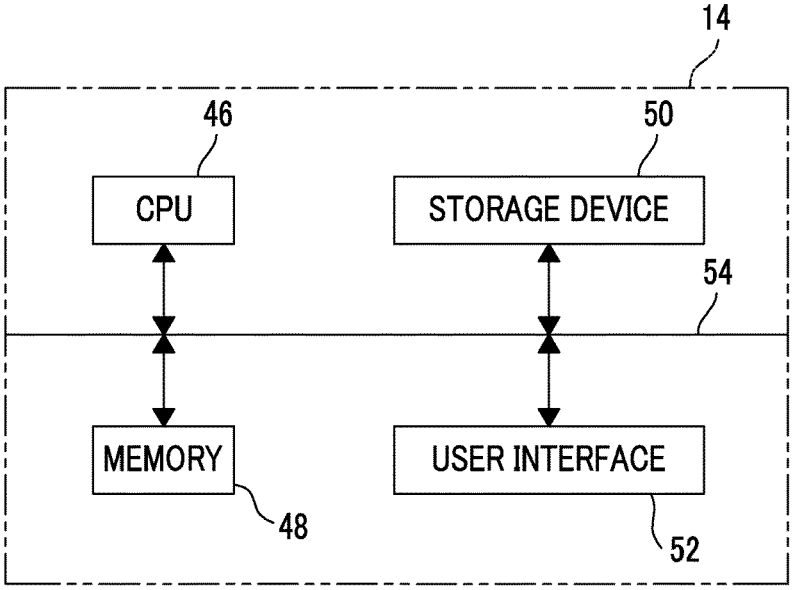
FIG. 4 is a block diagram illustrating an example of a circuit of an image formation control apparatus according to the exemplary embodiment of the present invention.

The image formation control apparatus 14 is configured with, for example, a personal computer, is connected to a control unit in the image forming apparatus main body 12, and, together with the control unit, controls the image forming apparatus main body 12. As illustrated in FIG. 4, the image formation control apparatus 14 includes a CPU 46, a memory 48, a storage device 50, and a user interface 52. The CPU 46, the memory 48, the storage device 50, and the user interface 52 are connected to each other via a control bus 54.

The CPU 46 performs a predetermined process based on a control program which is stored in the memory 48. The user interface 52 is connected to an operation display apparatus 56. The operation display apparatus 56 includes, for example, a touch panel, receives a setting operation or the like, and displays a screen used to perform the setting operation.

The storage device 50 includes, for example, a hard disk or the like, and stores data which is necessary to control the image forming apparatus 13.

It is necessary to perform various adjustments on the image forming apparatus 13. The adjustments are relevant to the recording medium and the image formation. The adjustment relevant to the recording medium is performed in a case where the recording medium, which is fed from the recording medium accommodation unit 16, is deviated longitudinally and laterally. Although deviation is generated from a mechanical error of a feeding roller which feeds the recording medium from the recording medium accommodation unit 16, a deviation quantity becomes different according to a type of the recording medium. For example, a size and a basis weight of the recording medium, coated paper, normal paper, and the like become a cause of the deviation. In addition, the adjustment relevant to the image formation is performed on a density, a gradation, a hue, and a color deviation of an image. For example, the density of the image is adjusted by the secondary transfer voltage.

It is possible to acquire adjustment data with respect to adjustment factors for each print target (job). However, in a case where the adjustment data is acquired in advance and is stored as a database and is called if necessary, it is fast in time and is convenient.

Figure 5:
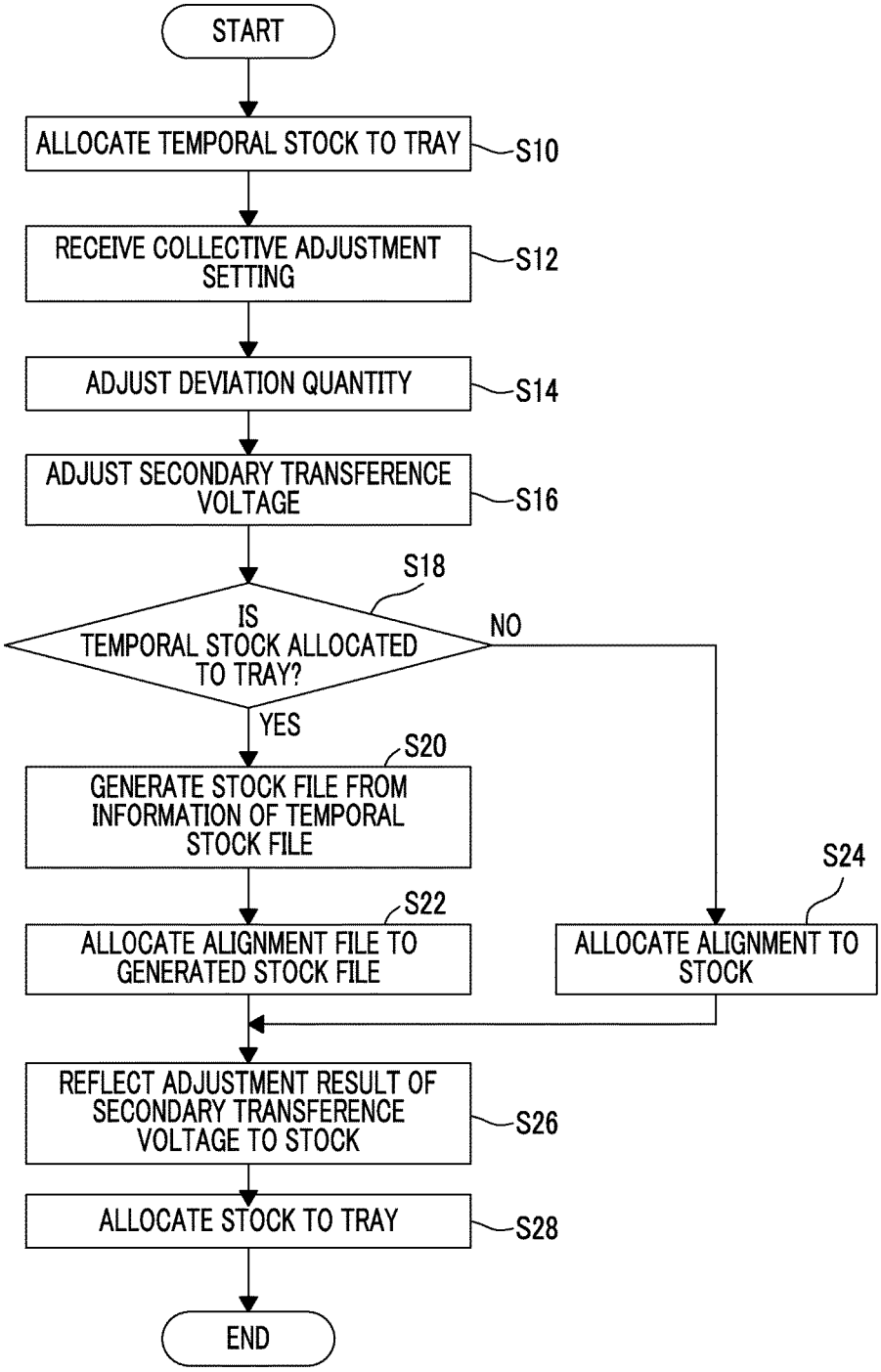
FIG. 5 is a flowchart illustrating a processing flow for forming a database of adjustment factors in the image formation control apparatus according to the exemplary embodiment of the present invention.

FIG. 5 illustrates a processing flow used to form a database of the adjustment factors. In the exemplary embodiment, the deviation quantity of the recording medium and the secondary transfer voltage are used as the adjustment factors.

First, in step S10, temporal stocks are allocated to the trays. Meanwhile, the stocks are series of data stored with respect to a storage target, and the temporal stocks are stocks which are temporally used.

Figure 6:
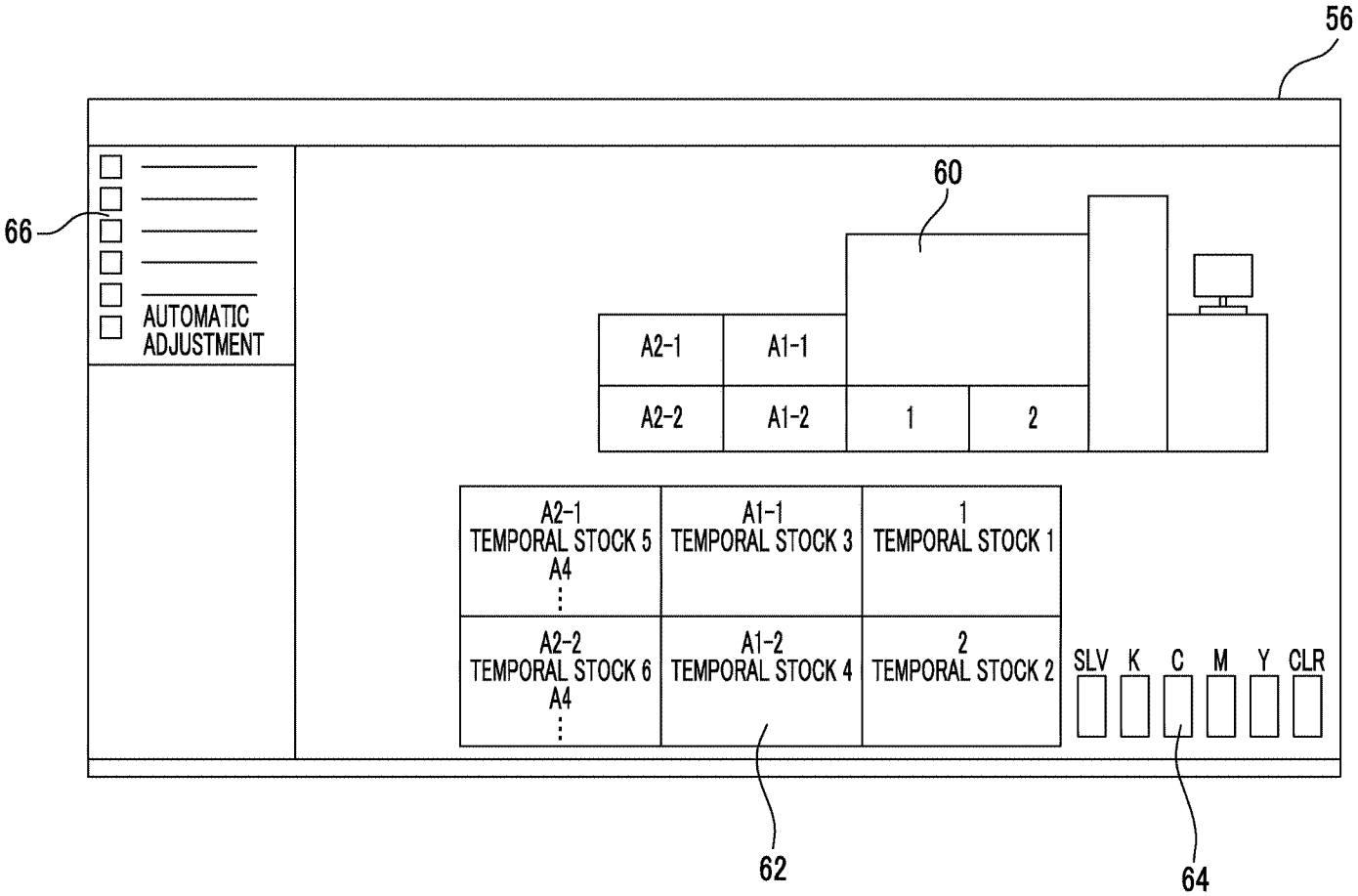
FIG. 6 is a diagram illustrating a screen which shows an initial state in which temporal stocks are allocated to respective trays in the image formation control apparatus according to the exemplary embodiment of the present invention.

FIG. 6 is a diagram illustrating a screen which shows an initial state in which the temporal stocks are allocated to the respective trays.

An initial screen includes a pattern display 60 of the image forming apparatus 13, a tray state display 62 which displays states of the trays, a developer color display 64 which displays developer colors which are disposed on the respective image forming units, and an operation display 66 in which plural operation checkboxes are displayed. In the initial screen, for example, a temporal stock 1 is allocated to the tray 1.

In subsequent step S12, collective adjustment setting is received.

Figure 7:
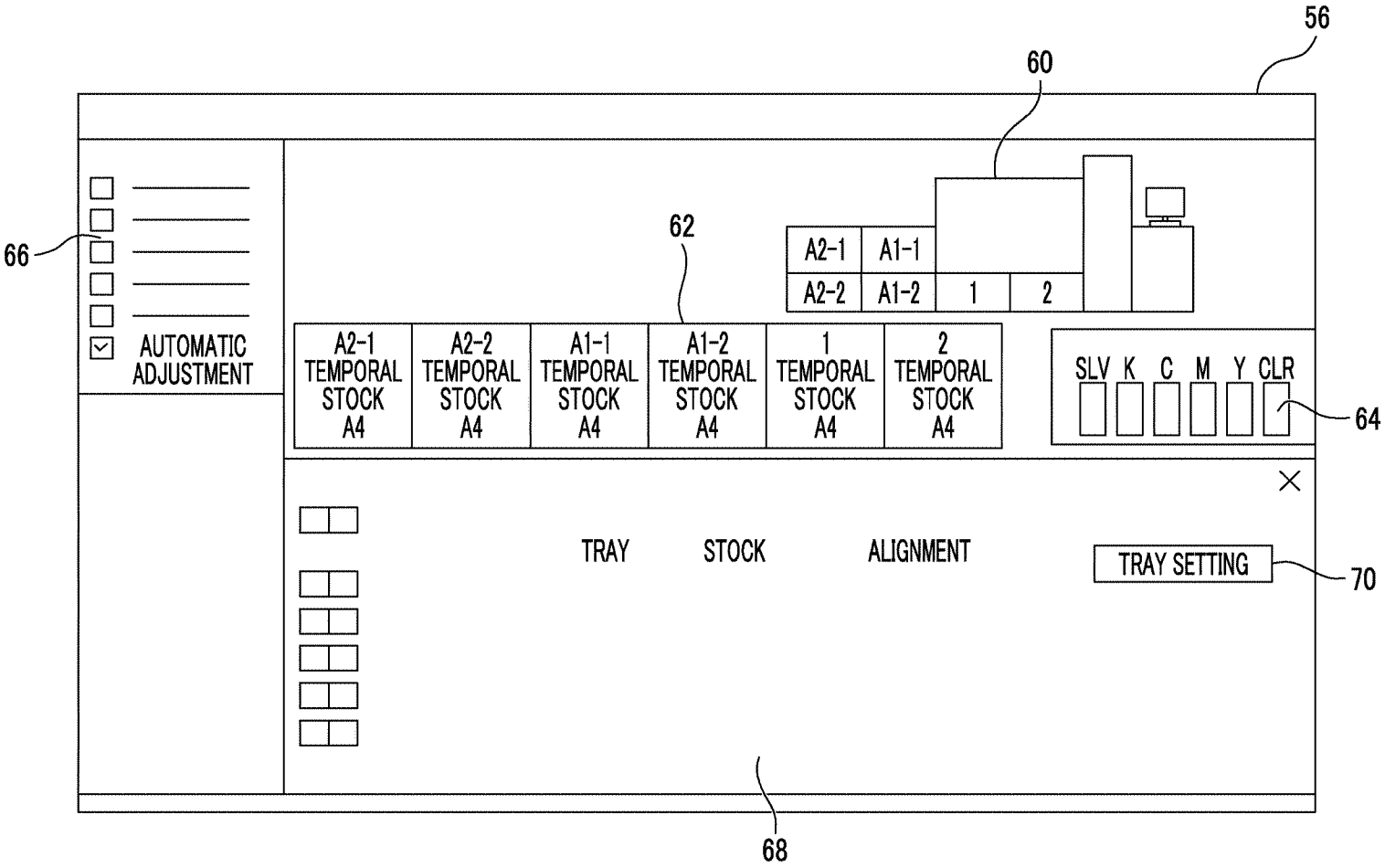
FIG. 7 is a diagram illustrating a screen in which collective adjustment setting is performed in the image formation control apparatus according to the exemplary embodiment of the present invention.

FIG. 7 is a diagram illustrating a screen in which the collective adjustment setting is performed.

In the collective adjustment setting screen, the pattern display 60, the tray state display 62, and the developer color display 64 are moved to an upper part and are displayed small, and an automatic adjustment setup display 68 is displayed at a lower part of the pattern display 60, the tray state display 62, and the developer color display 64. The collective adjustment setting starts in a case where an operation checkbox "automatic adjustment" which is displayed on the operation display 66 is checked.

Meanwhile, a tray setting button 70 is displayed on the automatic adjustment setup display 68. The tray setting button 70 is used in a case where content of a temporal stock to be performed is changed.

Figure 8:
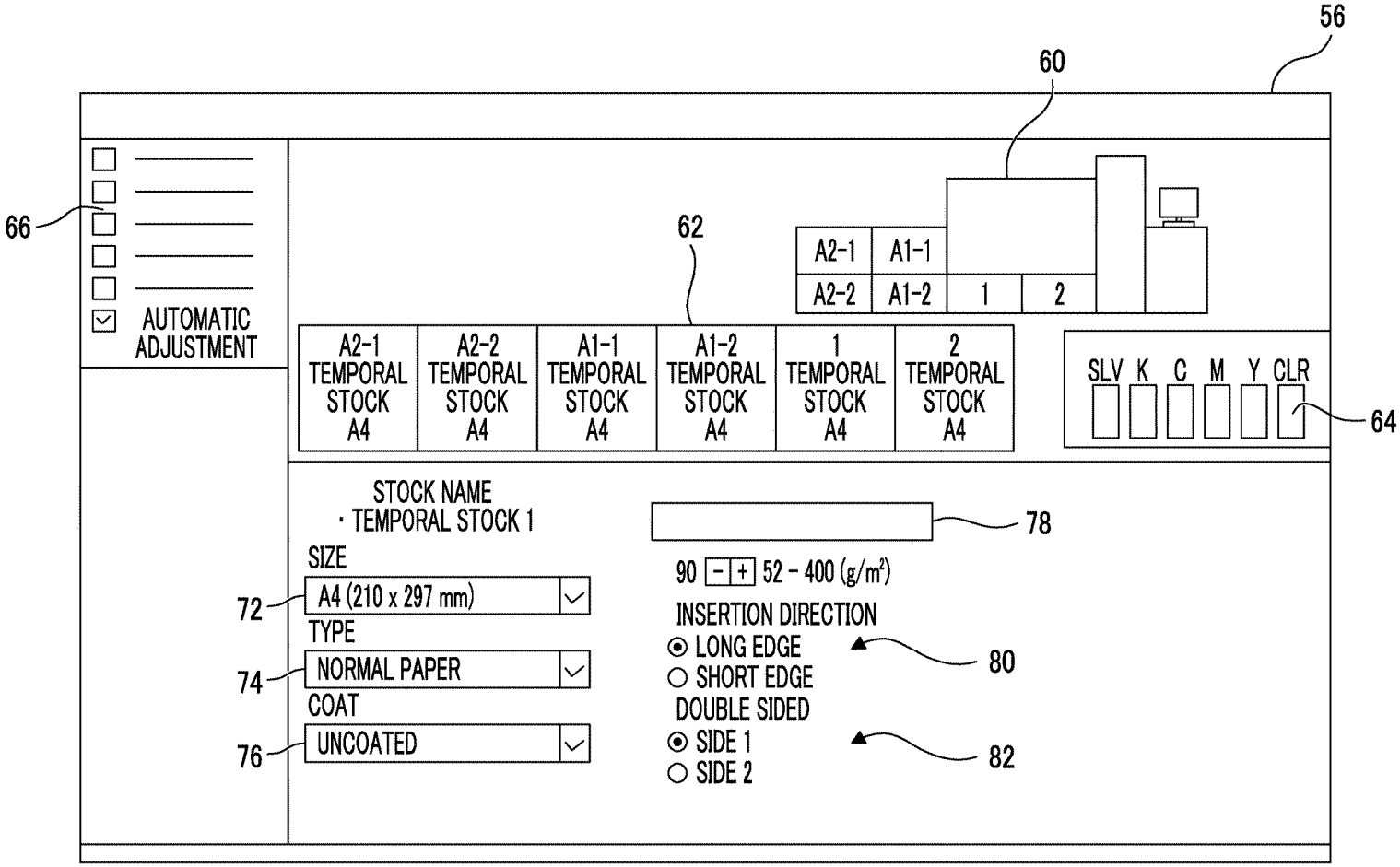
FIG. 8 is a diagram illustrating a screen used to change content of the stocks in the image formation control apparatus according to the exemplary embodiment of the present invention.

That is, in a case where the tray setting button 70 is clicked, a stock setting screen is displayed, as illustrated in FIG. 8. In the stock setting screen, a recording medium size change unit 72, a recording medium type change unit 74, a recording medium coat change unit 76, a recording medium basis weight change unit 78, a recording medium conveyance direction change unit 80, and a recording medium two-side and one-side change unit 82 are displayed. Although the size change unit 72 is set to A4 in the temporal stock 1, it is possible to select B4, A3, or the like. Although the type change unit 74 is set to the normal paper in the temporal stock 1, it is possible to select OHP or the like. Although the coat change unit 76 is set to uncoated in the temporal stock 1, it is possible to change to coated. In addition, although the basis weight change unit 78 is set to 90 g/m$^2$ in the temporal stock 1, it is possible to change, for example, in a range of 52 to 400 g/m$^2$. Furthermore, although the conveyance direction change unit 80 is set to a long edge in the temporal stock 1, it is possible to change to a short edge. Furthermore, although the two-side and one-side change unit 82 is set to a first surface in the temporal stock 1, it is also possible to set two sides by selecting a second surface.

Meanwhile, it is possible to separately set the first surface and the second surface. For example, it is possible to perform setting such that the first surface is coated and the second surface is uncoated.

Figure 9:
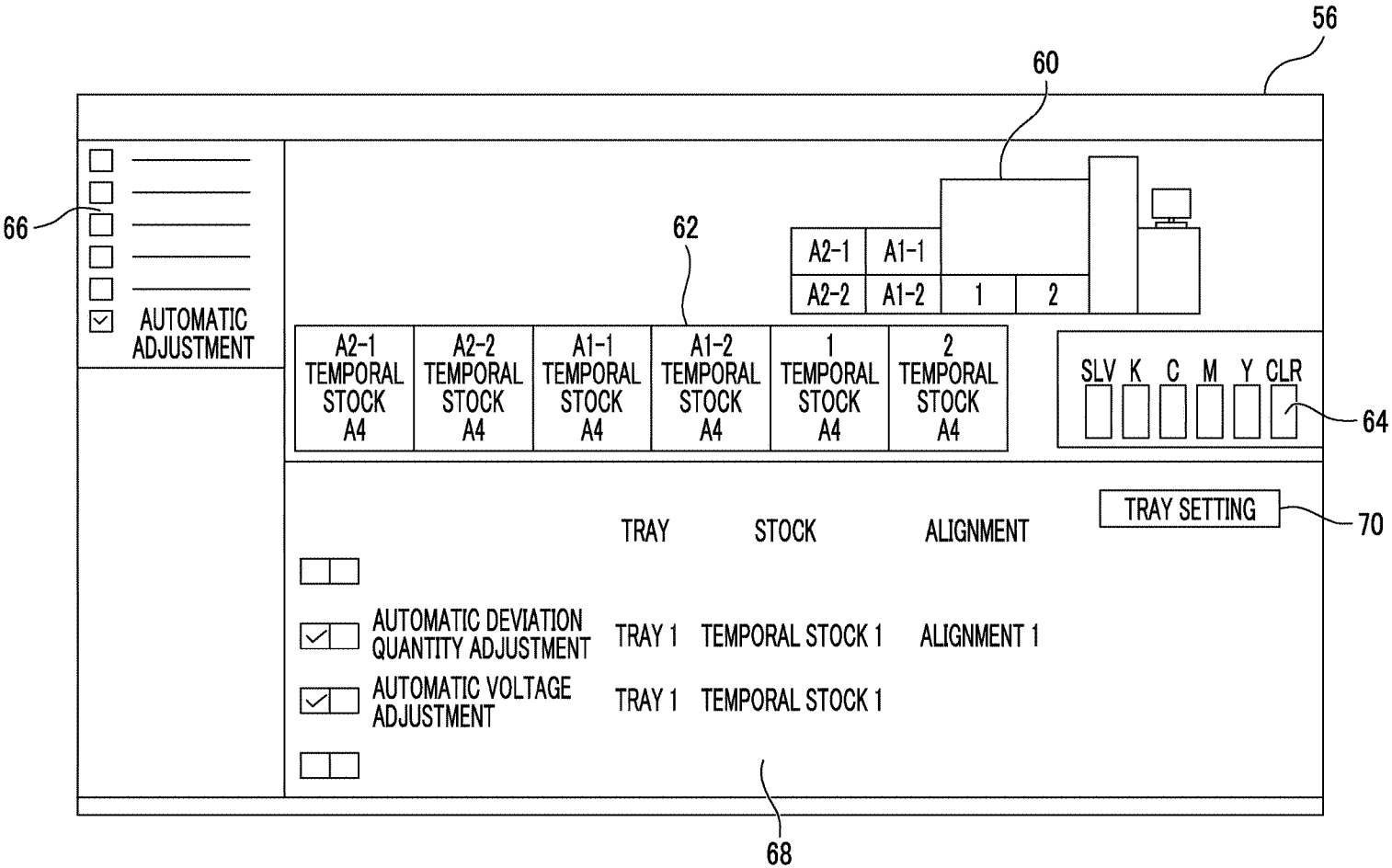
FIG. 9 is a diagram illustrating a screen illustrating content of automatic adjustment setup in the image formation control apparatus according to the exemplary embodiment of the present invention.

In a case where the operation checkbox "automatic adjustment" is checked in step S12, as illustrated in FIG. 9, content, which is set, is displayed on the automatic adjustment setup display 68. That is, in the exemplary embodiment, the adjustment factors are the deviation quantity of the recording medium and the secondary transfer voltage, the target tray is the tray 1, the stock is the temporal stock 1, and an alignment profile (a file which stores the deviation quantity of the recording medium) is alignment 1. In the alignment 1, normally, a notification that the deviation quantity of four corners of the recording medium is 0 is recorded.

In a case where the process in step S12 ends, deviation quantity adjustment and secondary transfer voltage adjustment are instructed to the image forming apparatus main body 12 as in step S14 and step S16.

Meanwhile, the processes in step S14 and step S16 are not performed separately but performed collectively.

That is, in the image forming apparatus main body 12, first, a test recording medium is conveyed from the tray 1. In contrast, a test toner image is formed in the image forming units 24, and the test toner image is transferred to the intermediate transfer belt 22.

A test image, which is formed on the intermediate transfer belt 22, is transferred to the test recording medium, which is conveyed from the tray 1, by the secondary transfer roller 38. The recording medium, to which the test image is transferred, is fixed and cooled through the fixing unit 40 and the cooling unit 42, and is read by the reading device 44. The reading device 44 reads, for example, locations of the four corners of the recording medium and reads a density measurement patch which is formed in the test image. The deviation quantity and the secondary transfer voltage are adjusted based on the read information.

Figure 10:
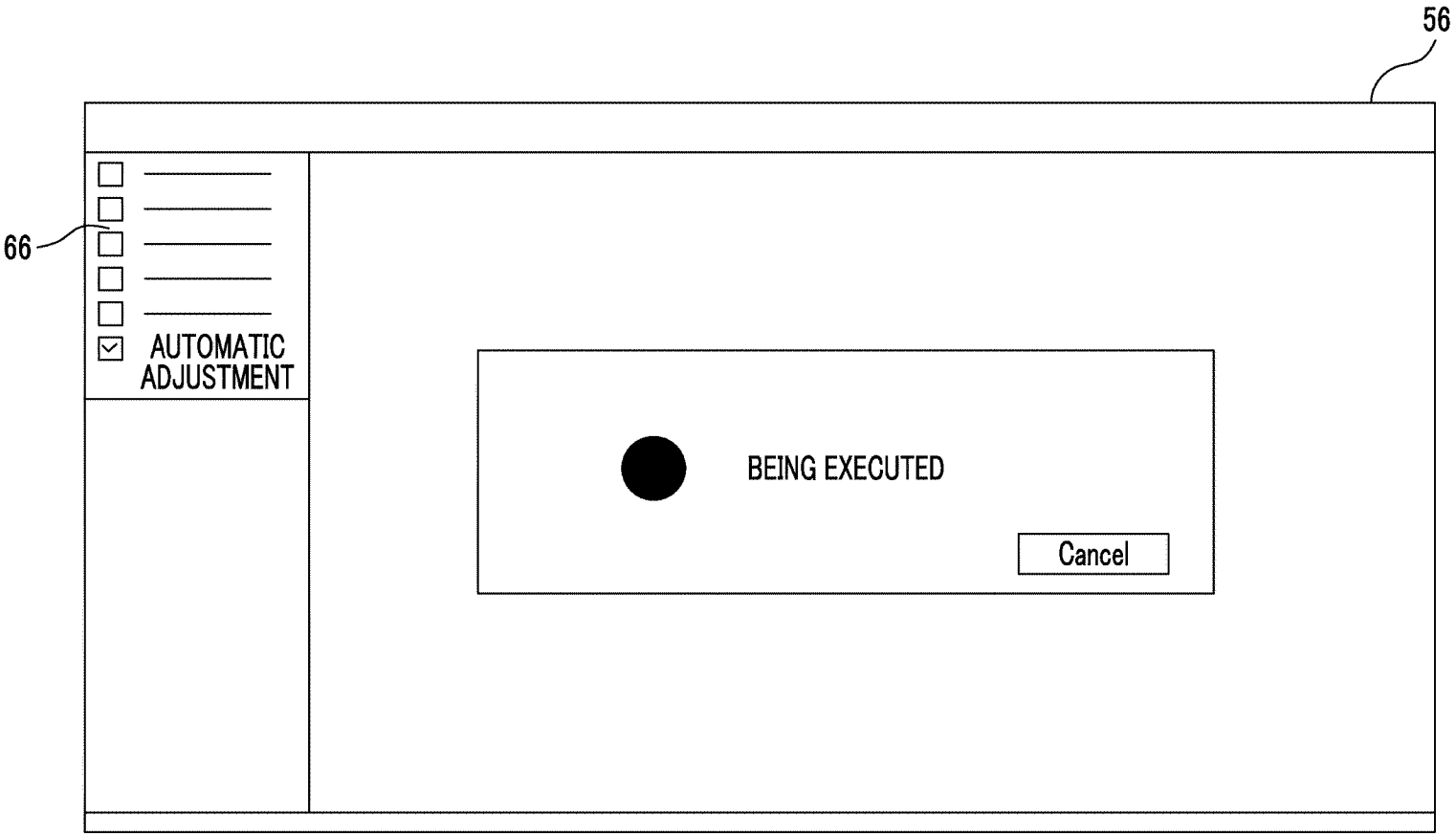
FIG. 10 is a diagram illustrating a screen illustrating a case where the automatic adjustment setup is performed in the image formation control apparatus according to the exemplary embodiment of the present invention.
Figure 11:
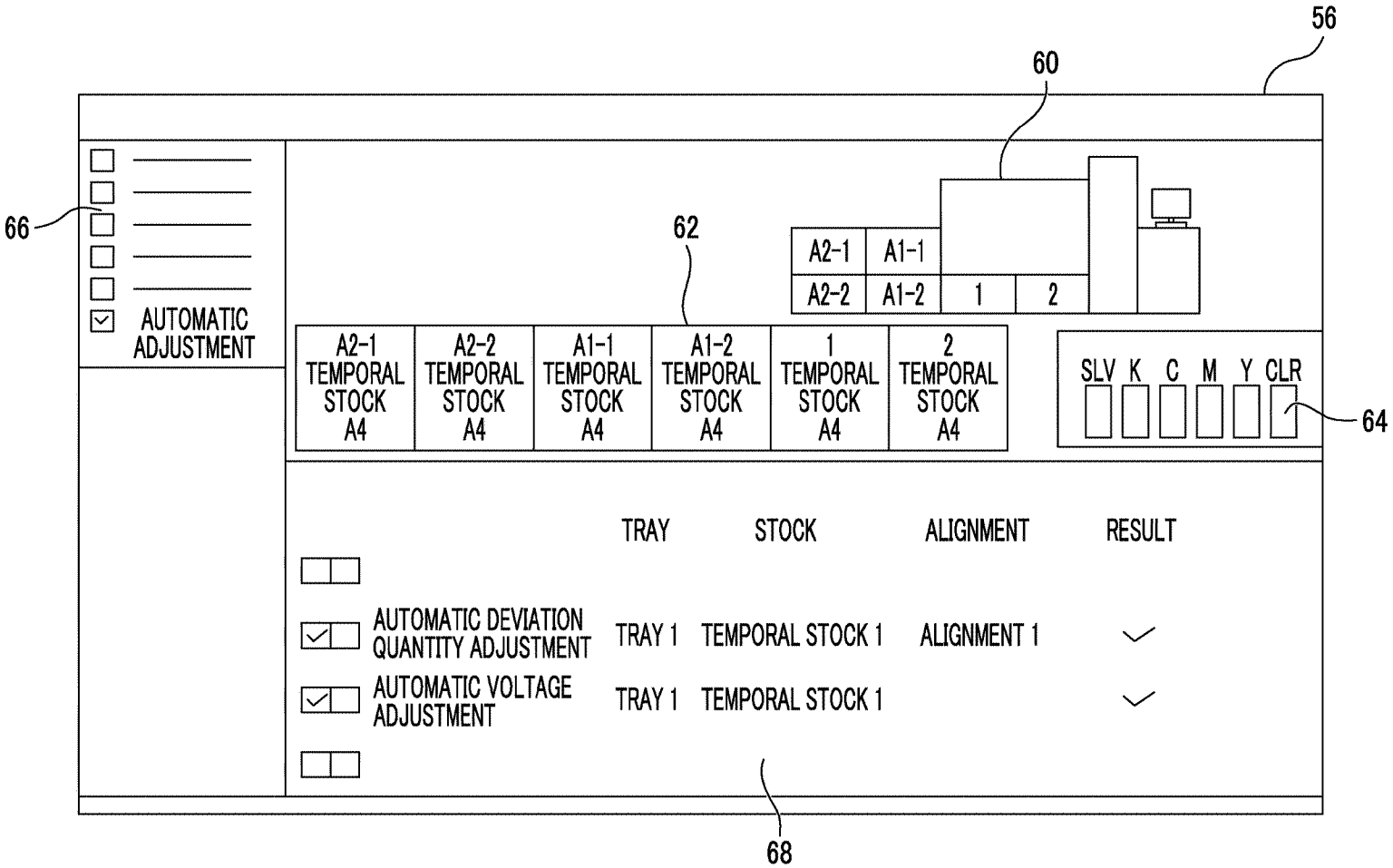
FIG. 11 is a diagram illustrating a screen illustrating a case where the automatic adjustment setup ends in the image formation control apparatus according to the exemplary embodiment of the present invention.

As described above, while the deviation quantity adjustment and the secondary transfer voltage adjustment are performed, "being executed" is displayed as illustrated in FIG. 10.

In subsequent step S18, it is determined whether or not the temporal stock is allocated to the tray. In a case where it is determined to be the temporal stock in step S18, the process proceeds to step S20, and a stock file is generated from a temporal stock file. In subsequent step S22, an alignment file is allocated to the generated stock file. In the exemplary embodiment, the temporal stock 1 is allocated to the tray 1. Therefore, it is determined to be the temporal stock in step S18, a stock is generated in step S20, and an alignment file 1 is allocated to the generated stock.

In contrast, in a case where it is determined that the temporal stock is not allocated, that is, a stock is already stored in step S18, the process proceeds to step S24, and the deviation quantity, which is acquired in step S14, is allocated to the stock which is already generated.

In a case where the process in step S22 or step S24 ends, the process proceeds to step S26, and an adjustment result, which is acquired through the adjustment performed in step S16, is reflected in the stock. Furthermore, the stock is allocated to the tray in subsequent step S28. In the exemplary embodiment, for example, a stock 6 is allocated to the tray 1, and the process ends.

As a result of the above, a stock database is generated in the storage device 50, as illustrated in FIG. 12. That is, a stock name, a recording medium, a deviation quantity, a secondary voltage adjustment value, and data corresponding to the other adjustment factors are associated with each other, search is performed using the stock name, the recording medium, and the like, a stock is called, or the called stock is performed.

Meanwhile, in the exemplary embodiment, the stock database is generated in the storage device 50. However, the present invention is not limited thereto and, for example, it is possible to store the stock database in a server via a network or store the stock database in a storage medium such as a USB memory.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image formation control apparatus comprising:

a setting reception section that collectively receives settings of a plurality of adjustment factors with respect to image formation;

an instruction section that instructs an image forming apparatus main body to perform adjustments with respect to the settings of the adjustment factors, which are received by the setting reception section;

an adjustment result reception section that receives results of the adjustments of the respective adjustment factors, which are instructed by the instruction section, in the image forming apparatus main body; and a controller that performs control such that the results of the adjustments of the respective adjustment factors, which are received by the adjustment result reception section, are stored in company with a recording medium accommodation unit that accommodates a recording medium.

2. The image formation control apparatus according to claim 1, wherein the controller further performs control such that a type of the recording medium, which is accommodated in the recording medium accommodation unit, is stored together.

3. The image formation control apparatus according to claim 2, wherein the setting reception section includes a setting, which is relevant to the recording medium to be conveyed, as the adjustment factor.

4. The image formation control apparatus according to claim 3, wherein the setting reception section includes a deviation quantity of the recording medium to be conveyed as the adjustment factor.

5. The image formation control apparatus according to claim 2, wherein the setting reception section includes a density of an image, which is used for the image formation, as the adjustment factor.

6. The image formation control apparatus according to claim 5, wherein the setting reception section includes a secondary transfer voltage of a secondary transfer unit, which is transferred from an intermediate transfer object to the recording medium, as the adjustment factor.

7. The image formation control apparatus according to claim 6, wherein the setting reception section includes a setting, which is relevant to the recording medium to be conveyed, as the adjustment factor.

8. The image formation control apparatus according to claim 5, wherein the setting reception section includes a setting, which is relevant to the recording medium to be conveyed, as the adjustment factor.

9. The image formation control apparatus according to claim 8, wherein the setting reception section includes a deviation quantity of the recording medium to be conveyed as the adjustment factor.

10. The image formation control apparatus according to claim 1, wherein the setting reception section includes a density of an image, which is used for the image formation, as the adjustment factor.

11. The image formation control apparatus according to claim 10, wherein the setting reception section includes a secondary transfer voltage of a secondary transfer unit, which is transferred from an intermediate transfer object to the recording medium, as the adjustment factor.

12. The image formation control apparatus according to claim 11, wherein the setting reception section includes a setting, which is relevant to the recording medium to be conveyed, as the adjustment factor.

13. The image formation control apparatus according to claim 12, wherein the setting reception section includes a deviation quantity of the recording medium to be conveyed as the adjustment factor.

14. The image formation control apparatus according to claim 10, wherein the setting reception section includes a setting, which is relevant to the recording medium to be conveyed, as the adjustment factor.

15. The image formation control apparatus according to claim 14, wherein the setting reception section includes a deviation quantity of the recording medium to be conveyed as the adjustment factor.

16. The image formation control apparatus according to claim 1, wherein the setting reception section includes a setting, which is relevant to the recording medium to be conveyed, as the adjustment factor.

17. The image formation control apparatus according to claim 16, wherein the setting reception section includes a deviation quantity of the recording medium to be conveyed as the adjustment factor.

18. The image formation control apparatus according to claim 1, wherein the setting reception section receives the settings of the adjustment factors with respect to both a first surface and a second surface in a case of two-sided printing.

19. An image forming apparatus comprising:

an image forming apparatus main body that includes a recording medium accommodation unit which accommodates a recording medium, and that forms an image on the recording medium which is accommodated in the recording medium accommodation unit; and an image formation control apparatus that controls adjustment factors in the image forming apparatus main body, wherein the image formation control apparatus includes a setting reception section that collectively receives settings of a plurality of adjustment factors with respect to image formation, an instruction section that instructs the image forming apparatus main body to perform adjustments with respect to the settings of the adjustment factors, which are received by the setting reception section, an adjustment result reception section that receives results of the adjustments of the respective adjustment factors, which are instructed by the instruction section, in the image forming apparatus main body, and a controller that performs control such that the results of the adjustments of the respective adjustment factors, which are received by the adjustment result reception section, are stored in company with a recording medium accommodation unit.

20. The image forming apparatus according to claim 19, wherein the image forming apparatus main body forms a test image based on an instruction by the instruction section, further includes a reading section that reads the test image, and generates the results of the adjustments based on the image which is read by the reading section.

* * * * *